US006244002B1

(12) United States Patent
Martin

(10) Patent No.: US 6,244,002 B1
(45) Date of Patent: Jun. 12, 2001

(54) CABLE RACEWAYS FOR MODULAR SYSTEM FURNITURE

(76) Inventor: Pierre Martin, 280 Notre Dame, St. Pie, Quebec (CA), H2Y 2A4

( * ) Notice: Subject to any disclaimer, the term of this patent is extended or adjusted under 35 U.S.C. 154(b) by 0 days.

(21) Appl. No.: 09/193,363

(22) Filed: Nov. 17, 1998

Related U.S. Application Data

(60) Provisional application No. 60/065,642, filed on Nov. 18, 1997.

(51) Int. Cl.[7] ..... E04B 2/76

(52) U.S. Cl. ..... 52/220.7; 52/239; 52/282.1; 52/586.2

(58) Field of Search ..... 52/220.7, 239, 52/282.1, 282.2, 36.5, 36.6, 586.1, 586.2, 281

(56) References Cited

U.S. PATENT DOCUMENTS 4,120,124 * 10/1978 Temple et al. ..... 52/36.6

* cited by examiner

*Primary Examiner*—Michael Safavi
(74) *Attorney, Agent, or Firm*—Eric Fincham

(57) ABSTRACT

A modular panel system having a plurality of panels connected together, each of the panels would normally be of a rectangular configuration, the panels being connected together by means of a vertically extending member which is secured to side walls of the panels and an elongated flexible interconnecting member having first and second longitudinally extending side marginal edges and an enlarged edge portion designed to be retained by the vertically extending member. A U-shaped raceway member which may be placed on either the top or bottom of a panel or between panels to provide for horizontal cables.

15 Claims, 9 Drawing Sheets

FIG. 1
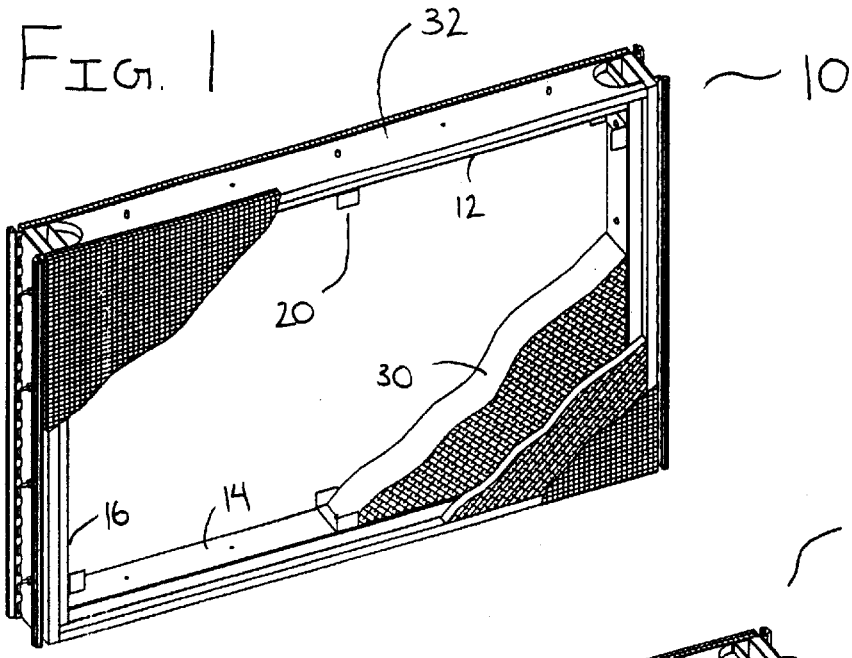
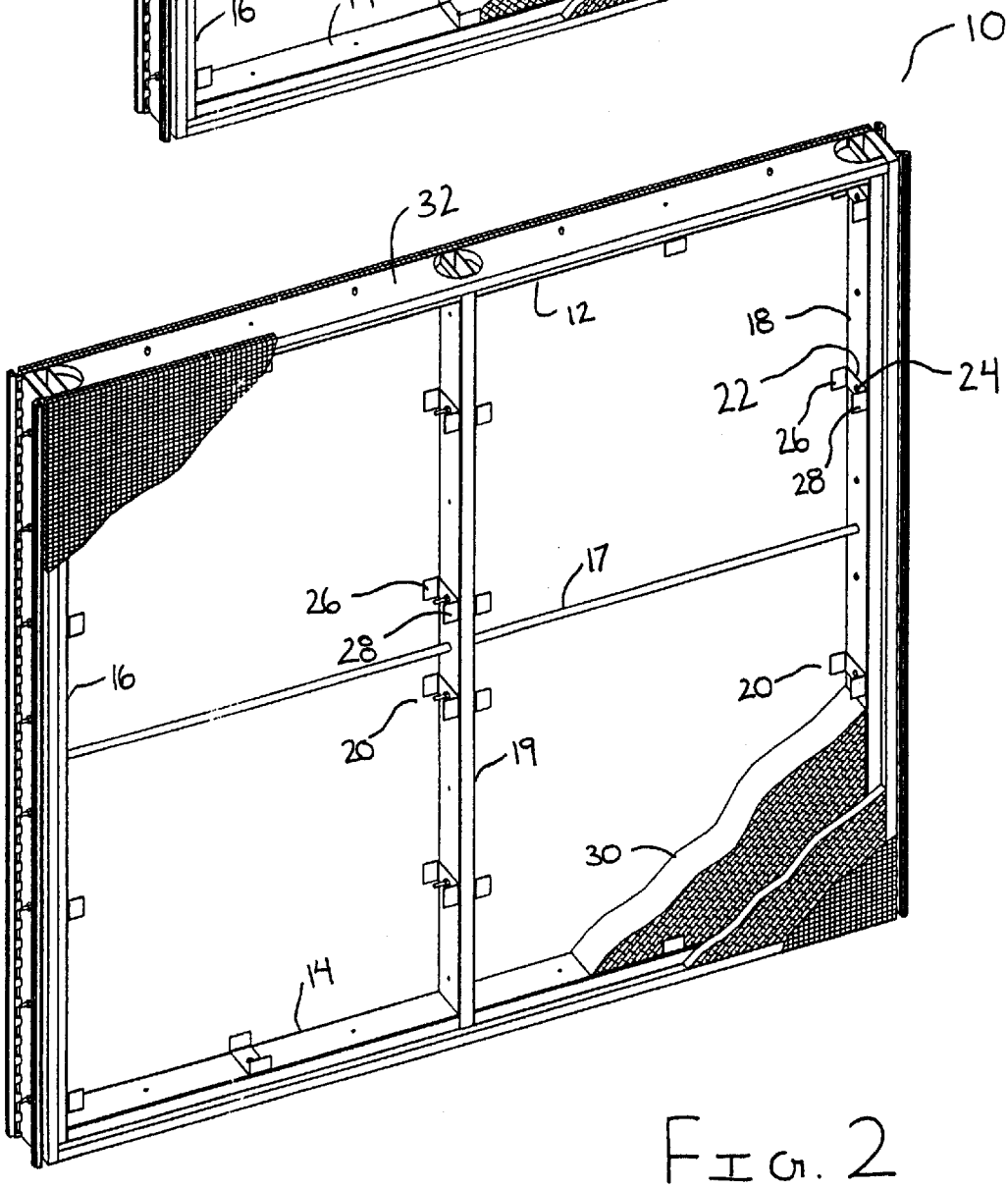
FIG. 2

78
10
7B
78
10
10
94
7C
10
10
94
94
10
10
94
94
10
10
10
94
7D
7E
10
10
94
7F

FIG. 9
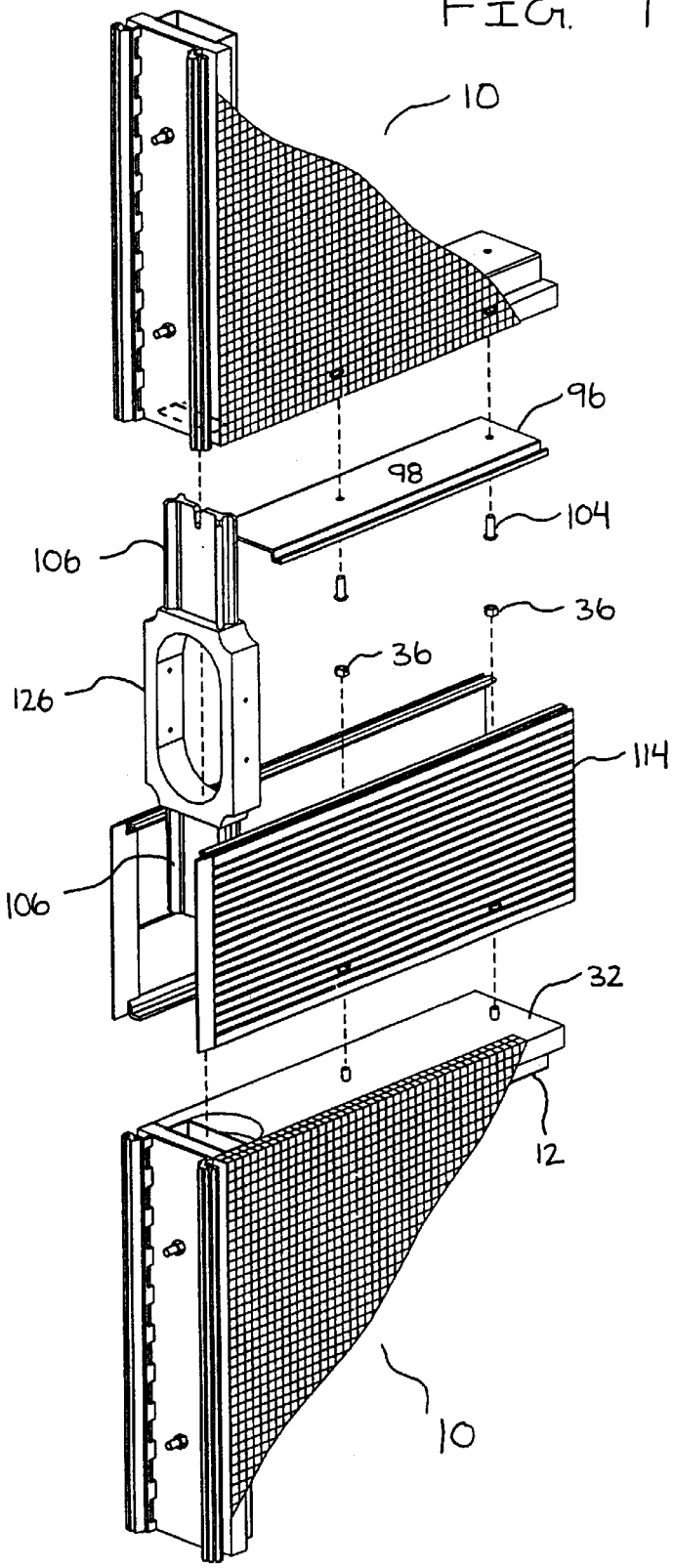
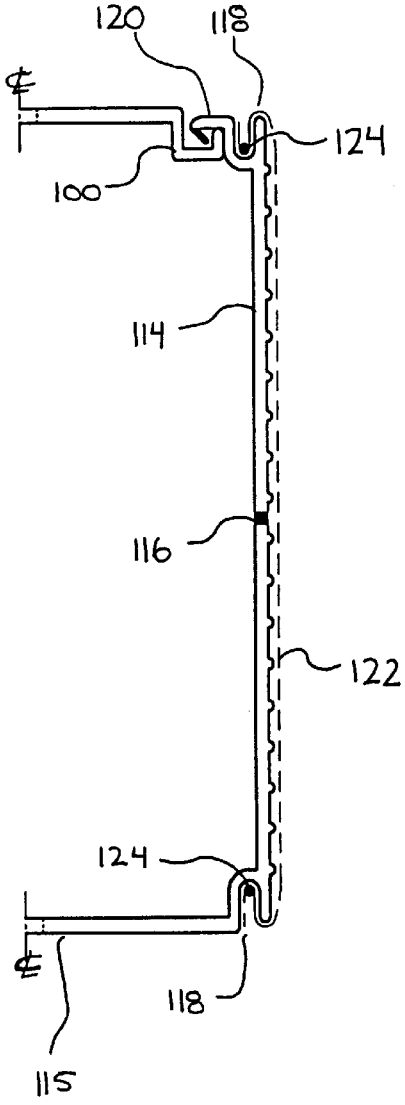
FIG 9A

CABLE RACEWAYS FOR MODULAR SYSTEM FURNITURE

This application claims the benefit of 60/065,642 filed Nov. 18, 1997.

FIELD OF THE INVENTION

The present invention relates to a modular panel system and more particularly, relates to a modular panel system used for forming dividers or the like for an office or other application.

BACKGROUND OF THE INVENTION

Office systems often use dividers, walls, and furniture to divide an open space to be used for work stations or other requirements.

Although wall panel systems are utilized in many modern offices, an increasingly prevalent problem is that of adequate cable management. Thus, practically every employee in a modern office requires a high degree of electrical, data and communications services for printers, fax machines, LAN's, telephones, intercoms, etc. The nature of any particular service can change rapidly and with the evolution of modern information technology equipment, a frequent change and/or addition to the equipment is required. All this equipment requires wiring or cabling and the amount of cabling can quite rapidly lead to confusion and cluttered arrangements.

In order to meet the above, there have been proposed a multitude of different types of assemblies and concepts. In prior art systems, some modular panels offer a cable raceway at the base of the panels and which must be shared by electrical, telephone and data cabling. It is also known to offer cable raceways at a surface height and intermediate thereof. Generally, the cable raceways in these systems are designed within the structure of the panels so that they are difficult to remove and relocate. This means that a system installed at a certain point in time must continue with the same concept if the office is to match esthetically. It becomes difficult to rearrange since the cable raceways are not modular and removable.

SUMMARY OF THE INVENTION

It is therefore an object of the present invention to provide a modular panel system which includes one or more cable raceways which can be installed between two panels, either at the base or on the top thereof.

It is a further object of the present invention to provide a modular panel system wherein the panels provide horizontal modular cable raceways and also provide means for interconnecting the panels, the interconnection means also providing cable raceways for passage of the cables.

According to one aspect of the present invention, there is provided a modular panel system comprising a panel, the panel having first and second opposed major faces, a frame comprised of a top wall, a bottom wall, and first and second side walls, connecting means located on at least one of the side walls for interconnecting the side wall to an adjacent side wall of an adjacent panel, the connecting means comprising a vertically extending member secured to the side wall, an elongated flexible interconnecting member having first and second longitudinally extending side marginal edges, each of the side marginal edges having means for attachment to the vertically extending member, and a cable raceway extending horizontally along at least one of the top and bottom walls, the cable raceway being secured to at least one of the top and bottom walls.

According to a further aspect of the present invention there is provided a modular panel system comprising a plurality of panels, each panel having first and second opposed major faces, a frame comprised of a top wall, a bottom wall and first and second side walls, a first one of the panels being located adjacent to a second one of the panels such that a first side wall of the first panel is adjacent to a second side wall of the second panel, connecting means located on the first side wall of the first panel and on the second side wall of the second panel, the connecting means comprising a vertically extending member secured to each of the first side wall of the first panel and the second side wall of the second panel, an elongated flexible interconnecting member having first and second longitudinally extending side marginal edges, each of the side marginal edges having an enlarged edge portion, each of the vertically extending members having a groove located therein designed to receive the enlarged edge portion of the elongated flexible interconnecting member, and a cable raceway extending horizontally along at least one of the top and bottom walls of at least one of the first and second panels.

In greater detail, the modular panel system of the present invention can be used to design various layouts of floor panels. Any one panel can be connected to another panel at any desired angle by means of the flexible interconnecting member while conventional arrangements using angles of 90° and 120° are readily achieved.

The modular panel system of the present invention permits for the use of wiring in both horizontal and vertical directions and provides easy access to the same such that any required changes can be simply and easily made without substantial changes to the arrangement of the modular panels. Still further, the system permits one to reorient the panels at any desired time.

BRIEF DESCRIPTION OF THE DRAWINGS

Having thus generally described the invention, reference will be made to the accompanying drawings illustrating an embodiment thereof, in which:

FIG. 1 is a perspective view, partially in cutaway, of a single panel showing the internal features thereof;

FIG. 2 is a perspective view, partially in cutaway, of a larger panel having a reinforcing structure associated therewith;

FIGS. 7A to 7F are perspective views of different arrangements of the modular panels in a stacking relationship to provide cable raceways;

FIG. 9 is an exploded view of one end of a cable raceway installed between two stacked modular panels;

FIG. 9A is a schematic view illustrating placement of a covering on the panels;

DESCRIPTION OF THE PREFERRED EMBODIMENTS

Figure 3:
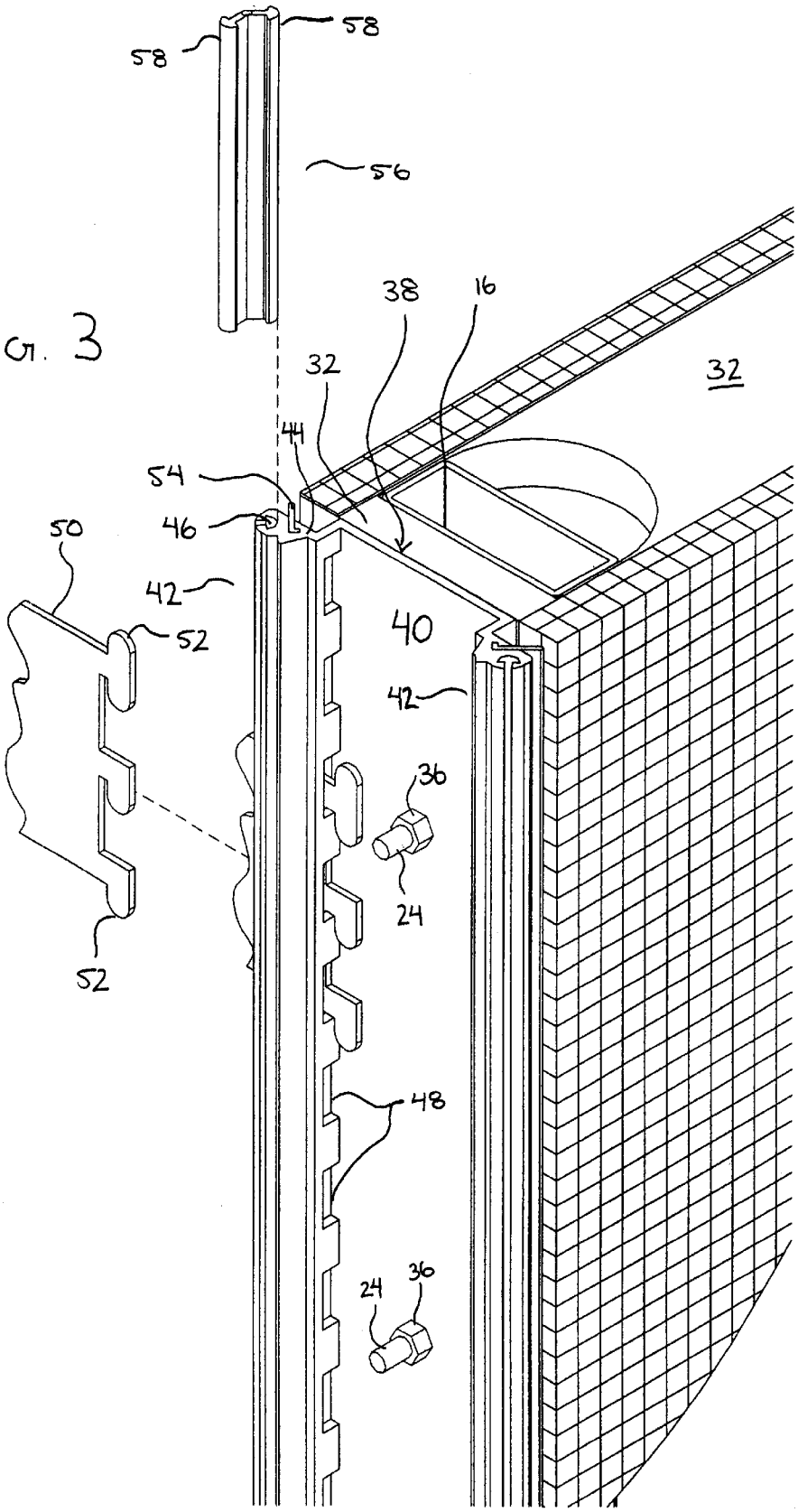
FIG. 3 is a detail view of a corner of a modular panel illustrating the means of connecting panels together.

Referring to the drawings in greater detail and by reference characters thereto, there is illustrated in FIG. 1 a modular panel which is generally designated by reference numeral 10. Modular panel 10 includes a top frame element 12, a bottom frame element 14, a first side frame element 16 and a second side frame element 18. Mounted interiorly on each of frame elements 12, 14, 16 and 18 are U-shaped retainers 20. Each U-shaped retainer 20 comprises a base portion 22 secured to its respective frame element by means of a machine screw 24 and a pair of outwardly extending arms 26 and 28. U-shaped retainers 20 are adapted to retain acoustic insulation 30 by means of arms 26 and 28. Mounted on the exteriorly facing surface of top frame element 12, bottom frame element 14, and side frame elements 16 and 18 are wood inserts 32.

A larger version of a modular panel is shown in FIG. 2; similar reference numerals are employed for this panel 10 as the components are substantially identical. It will, however, be noted that to provide sufficient rigidity to the panel, there is provided for a center frame element 19 extending between top frame element 12 and bottom frame element 14 along with a horizontal reinforcing bar 17 extending between side frame elements 16 and 18 and through center frame element 19.

Referring to FIG. 3, there is illustrated therein means of connecting adjacent panels together. In this arrangement, there is provided a side connector assembly generally designated by reference numeral 38 and which includes a base portion 40 with outwardly extending flanges 42 on either side thereof. A nut 36 on machine screw 24 retains side connector assembly 38 in the desired position.

Each flange 42 has formed therein a first vertical groove 44 and a second vertical groove 46. It will be noted that each flange 42 also has a plurality of apertures 48 formed therein. Apertures 48 are designed to receive and retain brackets 50 (only one shown), each of which has a hook shape structure 52 to sit therein in a conventional manner. Brackets 50 may be utilized to support various other elements such as shelves and the like or in the alternative, may have accessories to directly support other equipment such as computer monitors, work surfaces, etc.

There is provided a plastic extrusion 54 which is designed to fit within each of first vertical grooves 44. Plastic extrusion 54 extends outwardly to conceal apertures 48 to thereby provide an aesthetic finish.

A second plastic extrusion is in the form of a flexible connector 56. Flexible connector 56 has T-shaped ends 58 which are configured to fit within second vertical groove 46 and to be retained thereby.

Figure 4:
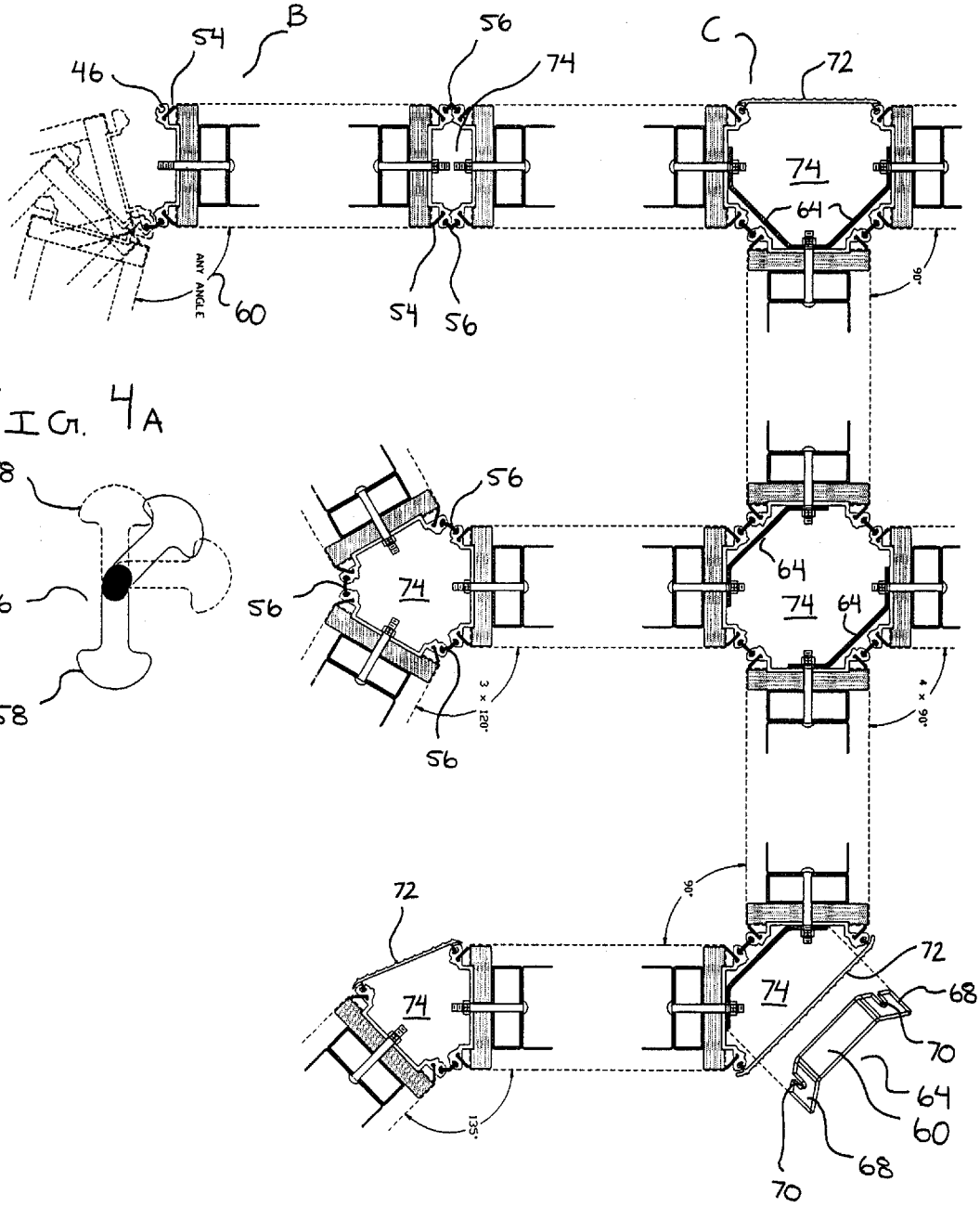
FIG. 4 is a top schematic view illustrating the connection of a plurality of modular panels together to define a modular wall.
Figure 4A:
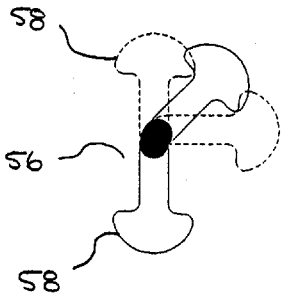
FIG. 4A is a cross sectional view of a flexible connector utilized in connecting the modular panels together.

Referring to FIG. 4, there are illustrated various different connections between modular panels 10. A generic example is provided at the top left portion of FIG. 4 as designated by reference character B wherein it will be seen that flexible connector 56 may be fit within second vertical grooves 46 of adjacent modular panels 10 and the panels may be moved at an angle with respect to each other as shown by reference numeral 60.

If additional rigidity is desired, a bracket generally designated by reference numeral 64 may be utilized. Generally, bracket 64 is used whenever two panels are installed in a mutually perpendicular configuration. Thus, as shown in FIG. 4 in the arrangement at the upper right hand portion thereof designated by C wherein three panels are connected in a mutually perpendicular configuration, a pair of brackets 64 may be utilized. Each bracket 64 has a base 68 with a pair of outwardly extending arms 68. A suitable aperture or slot 70 may be formed in arms 68 and they are secured in place by means of machine screws 24 and nuts 36.

In those instances wherein an open portion is provided (such as the three mutually perpendicular modular panels), a cover moulding 72 of an appropriate size may be utilized. Cover moulding 72 is designed to have vertically extending members to fit within and be retained by second vertical groove 46. Thus, as may be seen in FIG. 4, any number of possible configurations are possible utilizing the modular panel assembly of the present invention.

Figure 5:
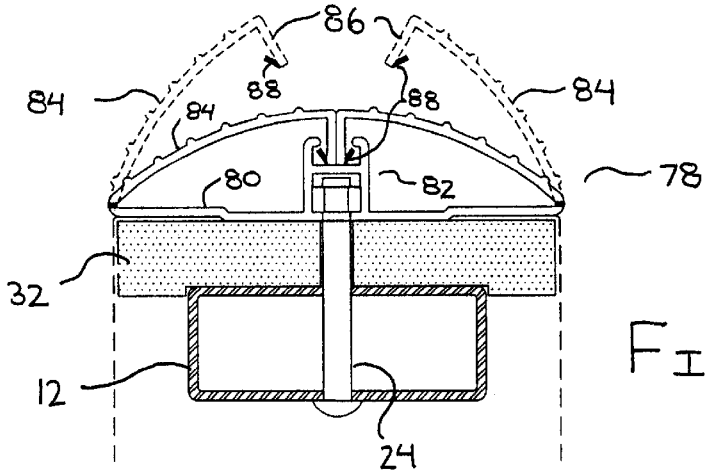
FIG. 5 is a cross sectional view through a top portion of a modular panel illustrating a top cover moulding in place thereon.

In one embodiment of the invention, as best seen in FIG. 5, there is provided a flexible top moulding generally designated by reference numeral 78. Flexible top moulding 78 has a base portion 80 designed to sit on top of wood insert 32. Extending upwardly from base 80 is an H-shaped retaining clip portion 82. A pair of upper segments 84 extend from the side marginal edges of base 80; each upper segment 84 has a downwardly extending arm 86. In turn, each arm has a flexible hook end 88 designed to fit within H-shaped retaining clip portion 82 as may be clearly seen in FIG. 5. It will be noted that flexible top moulding 78 also provides an inner cable raceway.

Figure 6:
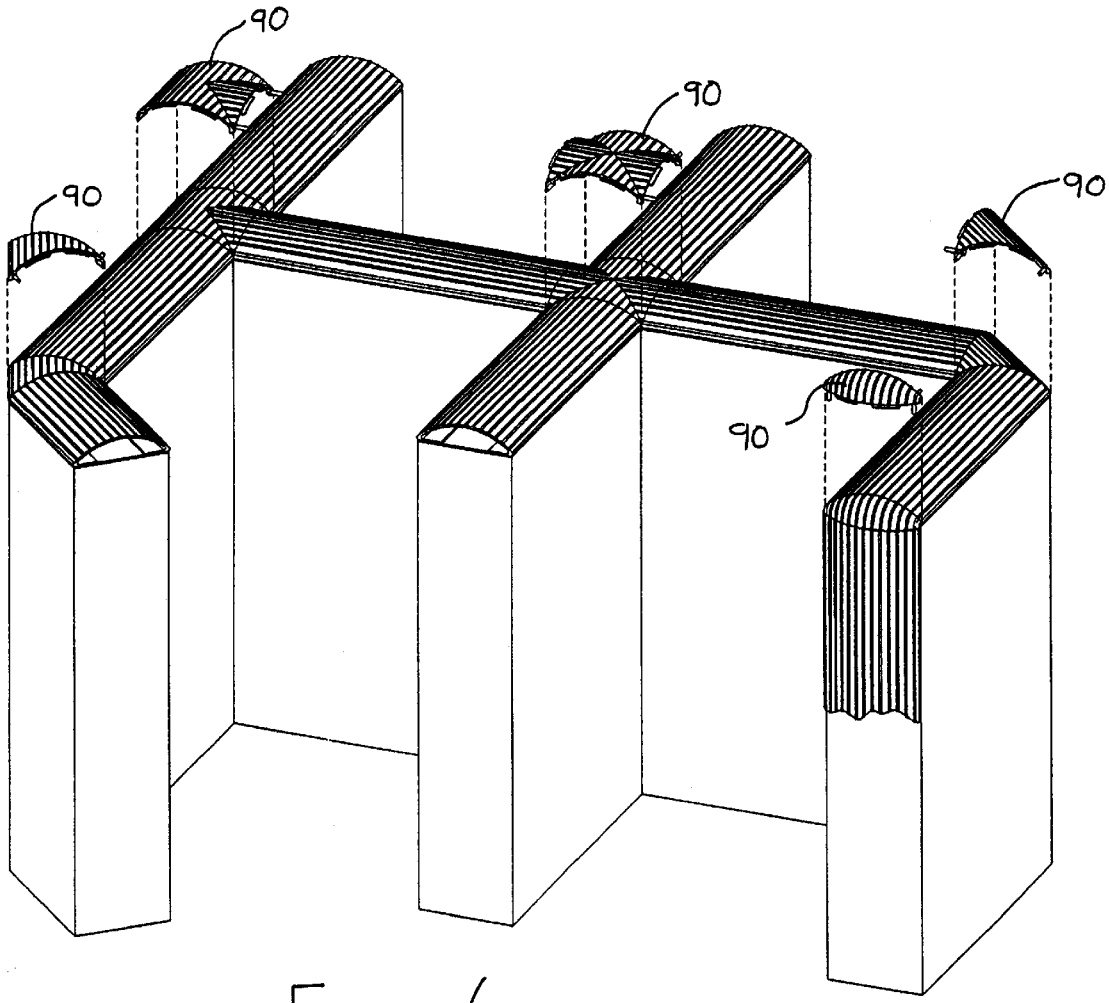
FIG. 6 is a perspective view of a modular panel assembly illustrating placement of the top cover moulding thereon.

As illustrated in FIG. 6, there may be provided top moulding fillers 90 of different configurations when a plurality of modular panels 10 are connected together.

Figure 8:
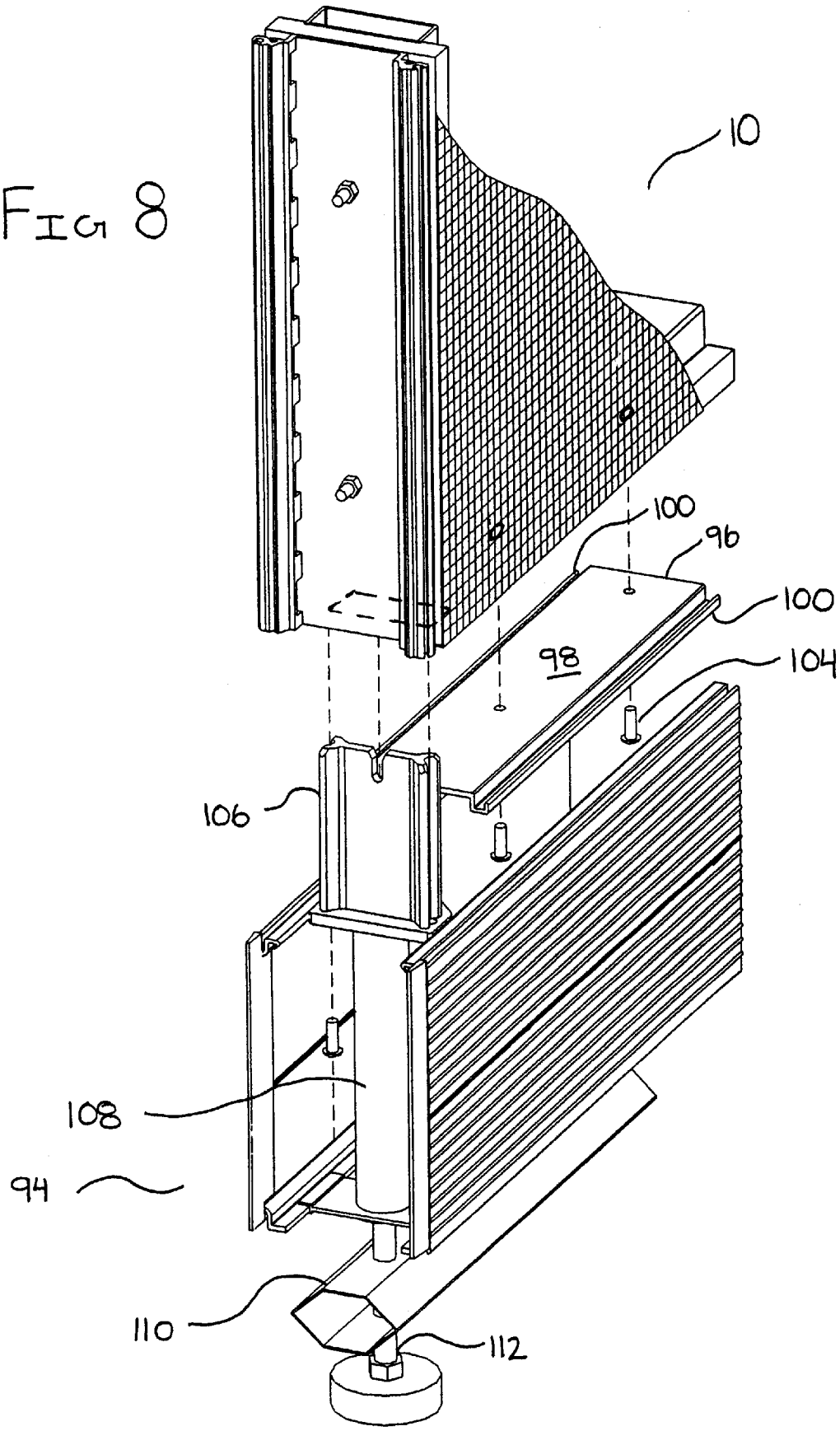
FIG. 8 is an exploded view of a panel having a horizontal cable raceway located at the bottom wall thereof.

Turning to FIG. 8, there is illustrated an embodiment utilizing a horizontal cable raceway which is generally designated by reference numeral 94. Cable raceway 94 is preferably extruded in a generally U-shaped configuration having a pair of side walls 114 and a horizontal portion 115 extending therebetween including an upper raceway element 96 which is comprised of a base 98 having first and second U-shaped flanges 100 at its longitudinally extending side edges. Upper raceway element 96 is secured in place by means of screws 104. An interior post 108 has a locating member 106 secured thereto and which locating member 106 is designed to fit within the interior aperture of side frame element 16 to thereby stabilize the structure. At the bottom, a leg 112 is screw threadably secured to post 108 while a bottom accordion type member 110 extends along the lower portion of raceway 94 for reasons discussed hereinbelow.

Figure 11:
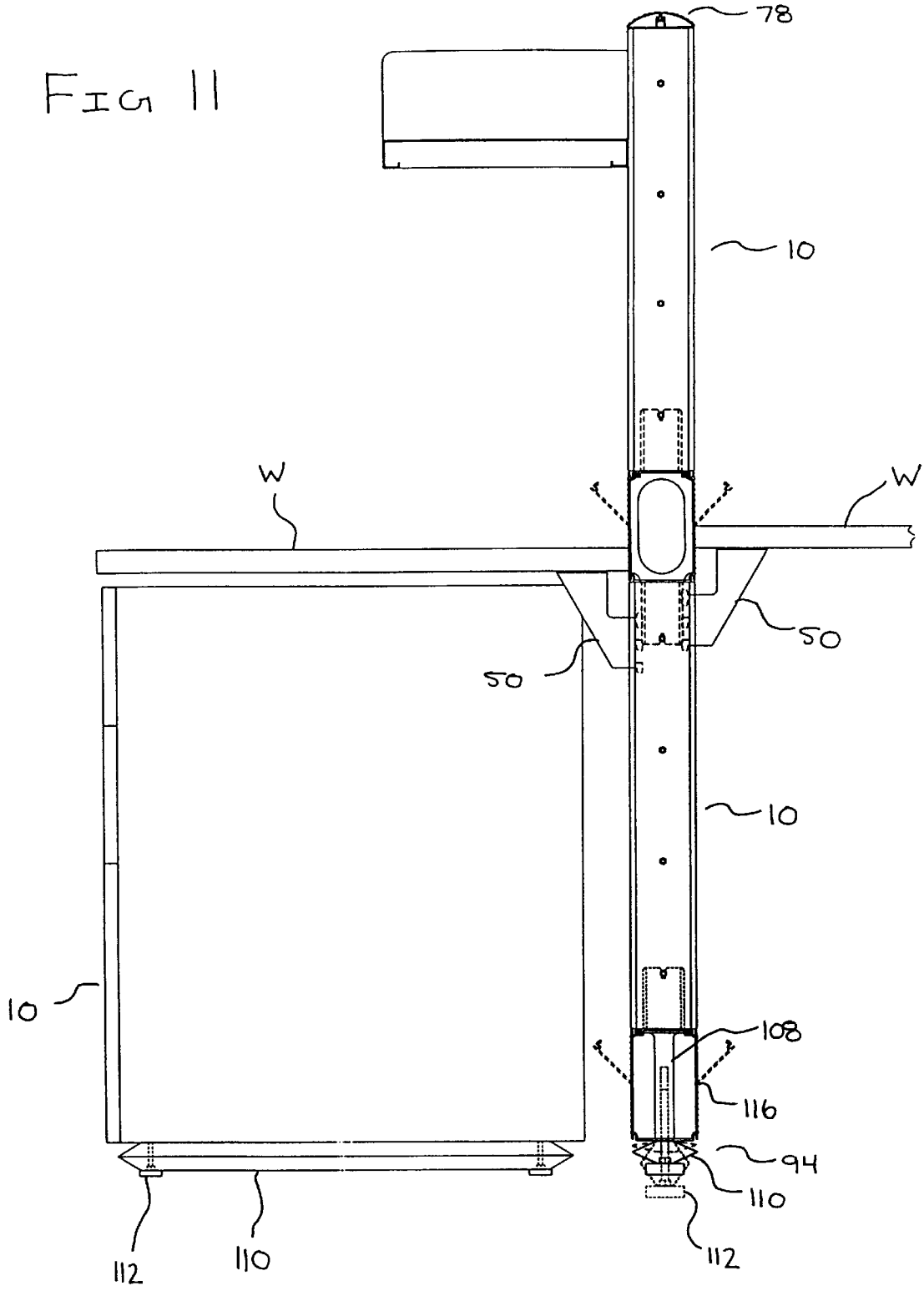
FIG. 11 is a side elevational view, partially in cutaway, of a modular panel system according to one embodiment of the present invention.

As may be best seen in FIGS. 9 and 9A, raceway side walls 114 are formed of a rigid material with a flexible port ion so that they may hinge outwardly as indicated at hinge line 116 (see FIG. 11). Raceway side walls 114 are also formed with U-shaped recesses 118 at the top and bottom thereof.

As shown in FIG. 9A, the upper marginal edge of raceway side wall 114 also includes a hook shaped end 120 designed to engage with U-shaped flange 100 of upper raceway element 96. A finishing material or fabric 122 is placed over raceway side wall 114 and is retained within U-shaped recesses 118 by means of a suitable spline material 124.

Figure 7A:
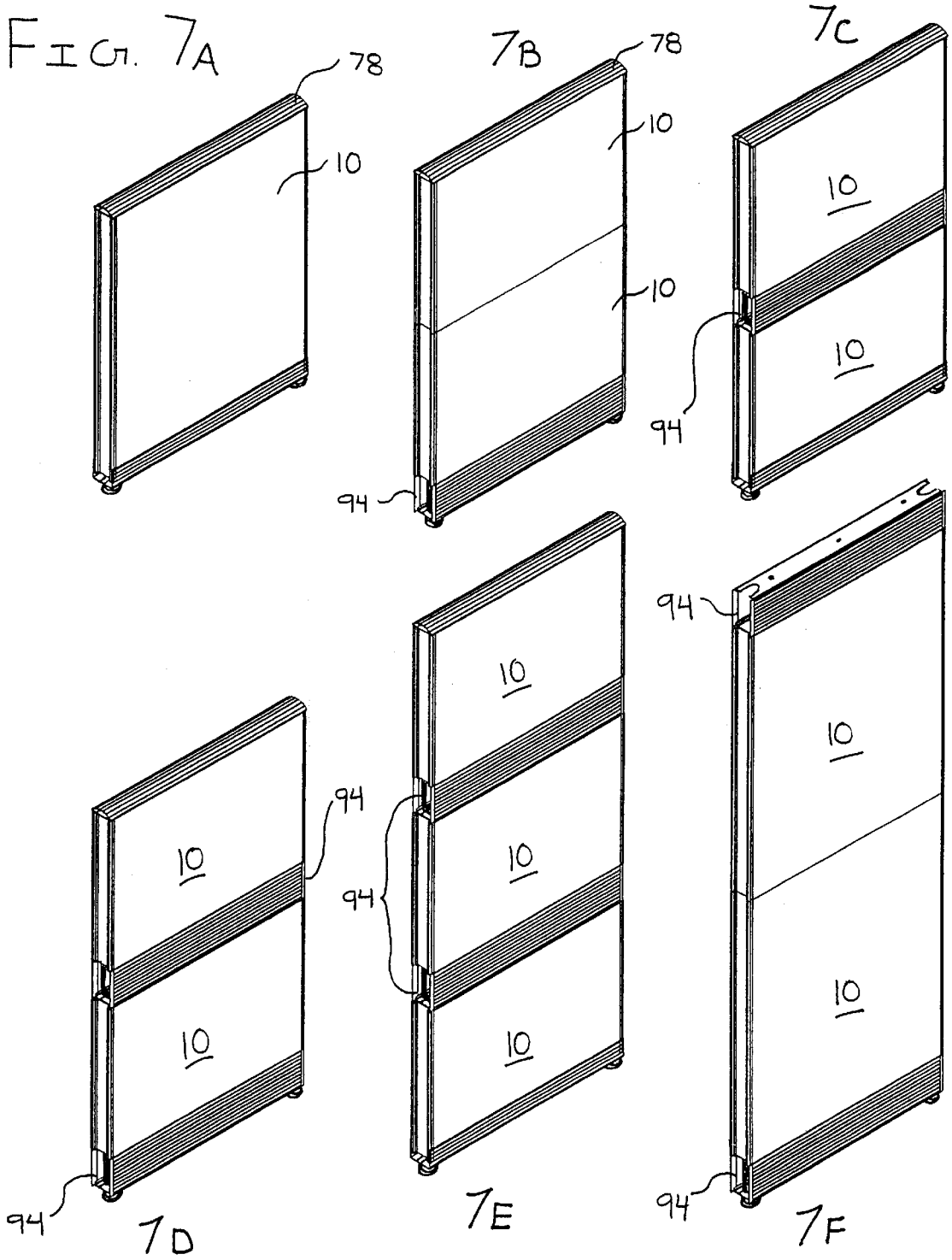

Turning to FIGS. 7A to 7F, there is illustrated in FIG. 7A a single modular panel having a U-shaped protection base 110 extending along the bottom edge of panel 10.

FIG. 7B illustrates a pair of modular panels 10 as secured one on top of the other with a cable raceway 94 extending along the bottom of the bottom most panel.

FIG. 7C illustrates two modular panels 10 wherein the cable raceway 94 is placed between the two modular panels.

FIG. 7D is an arrangement similar to FIG. 7C except that a second cable raceway 94 is provided at the bottom of the bottom most panel 10.

FIG. 7E illustrates three modular panels 10 stacked on top of each other with a cable raceway 94 being provided intermediate each of the panels.

FIG. 7F illustrates an arrangement wherein there are provided two modular panels 10 stacked one on top of the other with cable raceways 94 at the top and bottom of the modular panels 10.

Turning to FIG. 9, which illustrates an arrangement similar to that shown in FIG. 7C, a cable raceway 94 is provided intermediate to modular panels 10. As shown in this arrangement, instead of the use of a post 108, a connector box 126 is provided at the end of cable raceway 94. A similar connector box (not shown) is provided at the other end.

Figure 10:
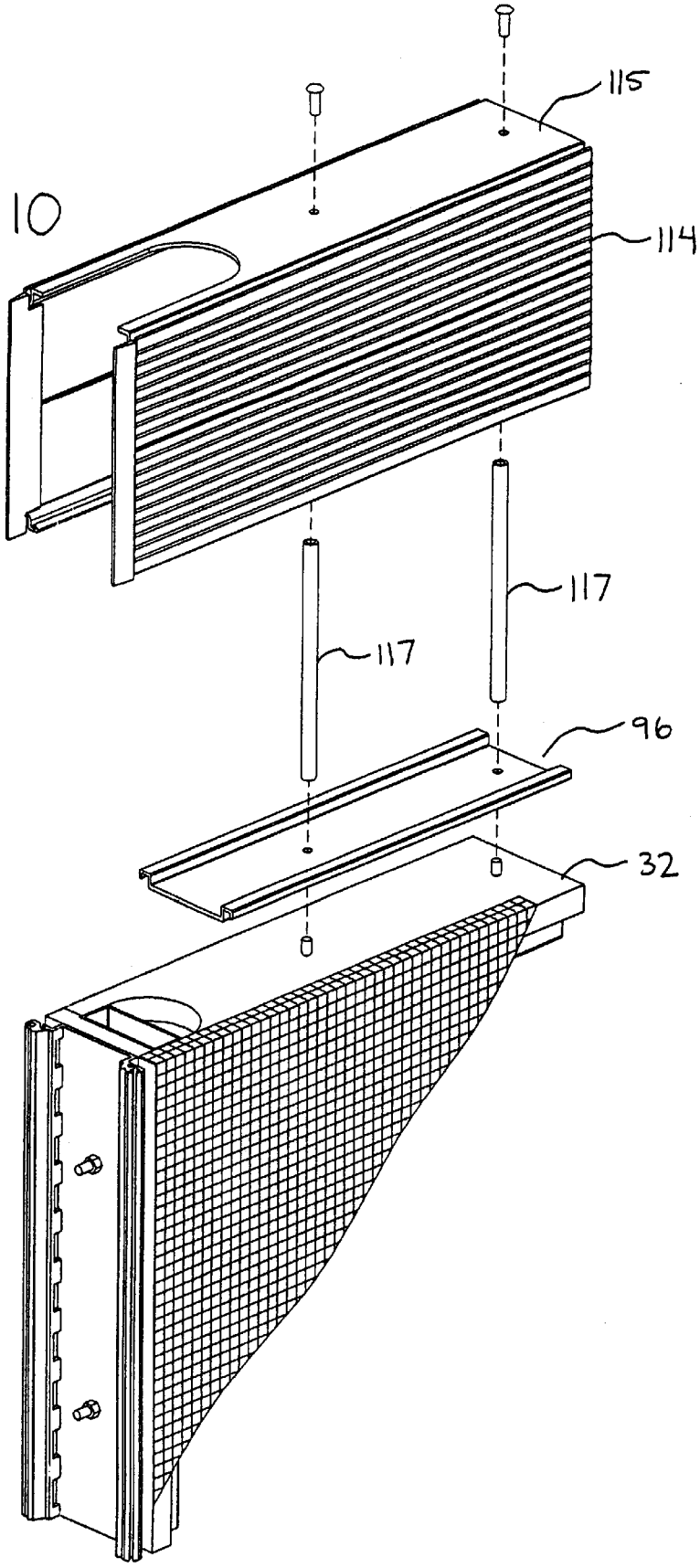
FIG. 10 is an exploded view illustrating placement of a cable raceway on top of a modular panel.

FIG. 10 illustrates an arrangement similar to that of FIG. 7F wherein cable raceway 94 is placed on top of a modular panel 10. In this embodiment, raceway 94 is placed in an inverted position and raceway element 98 is placed in a lower position. Spacer element 117 may then be employed.

As shown in FIGS. 7A to 7F and in FIG. 11, the modular panel assembly of the present invention has a high degree of versatility. This may include the use of a shelf 128 secured in place by means of brackets 50. Access is provided to the interior of the cable raceway so that wiring changes may be done at any desired time. Work surfaces W supported by brackets 50 may easily have access to required cabling due to hinge 116.

The typical partition setup for a work station normally has to be leveled due to uneven floors. Legs 112 provide this capability while with the provision of the flexible accordion-like bottom member 110, the gap between modular panel 10 and the floor can be sealed. This is illustrated by the dotted line outline in FIG. 11.

It will be understood that the above described embodiments are for purposes of illustration only and that changes and modifications may be made thereto without departing from the spirit and scope of the invention.

I claim:

1. A modular panel system comprising:

a panel, said panel having first and second opposed major faces, a frame comprised of a top wall, a bottom wall, and first and second side walls;

connecting means located on at least one of said side walls for interconnecting said side wall to an adjacent side wall of an adjacent panel;

said connecting means comprising a vertically extending member secured to said side wall, an elongated flexible interconnecting member having first and second longitudinally extending side marginal edges, each of said side marginal edges having means for attachment to said vertically extending member;

and a cable raceway extending horizontally along at least one of said top and bottom walls, said cable raceway being secured to said at least one of said top and bottom walls;

said vertically extending member comprising a base secured to said side wall, a pair of outwardly extending flanges located along side marginal edges of said base, each of said flanges having a longitudinally extending groove, and each of said side marginal edges of said elongated flexible interconnecting member having an enlarged edge portion designed to fit within and be retained by one of said grooves.

2. The system of claim 1 wherein said flange further includes apertures located therein designed to receive at least one bracket.

3. The system of claim 1 wherein said top wall, bottom wall, first and second side walls of said frame comprise hollow tubular members.

4. The system of claim 1 further including legs to support said panel, said legs being adjustable to vary the height of said panel, and a flexible member extending along said bottom wall, said flexible member being height adjustable to extend between said bottom wall and a floor.

5. The system of claim 4 further including insulation between said first and second opposed major faces, a plurality of retaining clips mounted on an interior face of each of said frame members, said retaining clips being designed to retain said insulation.

6. The modular panel system of claim 2 wherein each of said outwardly extending flanges of said vertically extending members includes a second groove formed therein, and a longitudinally extending finishing moulding being retained by each of said second grooves to conceal said apertures.

7. The modular panel system of claim 1 further including a cover moulding placed on said top wall, said cover moulding including a longitudinally extending cable receiving space located therein.

8. The modular panel system of claim 1 further including a wood insert secured to an exteriorly facing surface of each of said frame members.

9. The modular panel system of claim 7 wherein said cover molding comprises a base secured to said top wall, and a pair of arms hingedly connected to said base, said arms being moveable in between open and closed positions.

10. A modular panel system comprising:

a plurality of panels, each panel having first and second opposed major faces, a frame comprised of a top wall, a bottom wall and first and second side walls;

a first one of said panels being located adjacent to a second one of said panels such that a first side wall of said first panel is adjacent to a second side wall of said second panel;

connecting means located on said first side wall of said first panel and on said second side wall of said second panel;

said connecting means comprising a vertically extending member secured to each of said first side wall of said first panel and said second side wall of said second panel, an elongated flexible interconnecting member having first and second longitudinally extending side marginal edges, each of said side marginal edges having an enlarged edge portion;

each of said vertically extending members having a groove located therein designed to receive said enlarged edge portion of said elongated flexible interconnecting member;

and a cable raceway extending horizontally along at least one of said top and bottom walls of at least one of said first and second panels.

11. The modular panel system of claim 10 wherein said first and second panels extend substantially perpendicularly with respect to each other, and further comprising a reinforcing member secured to each of said first side wall of said first panel and said second side wall of said second panel.

12. The modular panel system of claim 11 further including a finishing moulding extending vertically between said vertically extending members.

13. The modular panel system of claim 10 further including legs to support each of said panels, said legs being adjustable to vary the height of a respective panel, and a flexible member extending along said bottom wall of said panel, said flexible member being height adjustable to extend between said bottom wall and the floor.

14. The modular panel system of claim 10 wherein said cable raceway comprises a U-shaped member having a base and a pair of side walls, and at least one of said walls having a flexible portion extending longitudinally thereof to permit hinged movement of a portion of said side wall.

15. The modular panel system of claim 10, comprising three panels, said panels extending at an angle of 120° with respect to each other, each of said panels being joined to an adjacent panel by means of said elongated flexible interconnecting member.

* * * * *